US007372424B2

(12) United States Patent
Mohuchy et al.

(10) Patent No.: US 7,372,424 B2
(45) Date of Patent: May 13, 2008

(54) HIGH POWER, POLARIZATION-DIVERSE CLOVERLEAF PHASED ARRAY

(75) Inventors: Wolodymyr Mohuchy, Nutley, NJ (US); Peter A. Beyerle, Kettering, OH (US); Michael Edward Pekar, Mason, OH (US); Kenneth Michael Reigle, Hoboken, NJ (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 172 days.

(21) Appl. No.: 11/352,785

(22) Filed: Feb. 13, 2006

(65) Prior Publication Data

US 2007/0188398 A1 Aug. 16, 2007

(51) Int. Cl.
*H01Q 1/38* (2006.01)

(52) U.S. Cl. ..... 343/795; 343/700 MS; 343/850; 343/853

(58) Field of Classification Search ..... 343/700 MS, 343/795, 797, 741–742, 793, 725, 853, 850, 343/757, 767
See application file for complete search history.

(56) References Cited

U.S. PATENT DOCUMENTS

| | | | | |
|---|---|---|---|---|
| 6,028,563 | A | 2/2000 | Higgins | |
| 6,208,293 | B1 * | 3/2001 | Adams et al. | 342/368 |
| 6,300,906 | B1 * | 10/2001 | Rawnick et al. | 343/700 MS |
| 6,342,866 | B1 * | 1/2002 | Ho et al. | 343/795 |
| 6,373,446 | B2 * | 4/2002 | Apostolos | 343/797 |
| 6,411,261 | B1 * | 6/2002 | Lilly | 343/756 |
| 6,421,018 | B1 * | 7/2002 | Zeilinger et al. | 343/713 |
| 6,441,368 | B1 * | 8/2002 | Grinberg et al. | 250/239 |
| 6,762,729 | B2 * | 7/2004 | Egashira | 343/767 |
| 6,812,893 | B2 * | 11/2004 | Waterman | 343/700 MS |
| 6,847,328 | B1 * | 1/2005 | Libonati et al. | 343/700 MS |
| 6,853,351 | B1 | 2/2005 | Mohuchy | |

(Continued)

FOREIGN PATENT DOCUMENTS

| | | |
|---|---|---|
| FR | 2 751 471 | 1/1998 |

(Continued)

OTHER PUBLICATIONS

J. T. Bernhard et al., "Electronically reconfigurable and mechanically conformal apertures using low-voltage MEMS and flexible membranes for space-based radar applications", Smart Structure and Materials, vol. 4334, 2001, pp. 129-136.

(Continued)

*Primary Examiner*—Douglas W. Owens
*Assistant Examiner*—Chuc Tran
(74) *Attorney, Agent, or Firm*—RatnerPrestia

(57) ABSTRACT

A phased array antenna includes a substrate, and multiple radiating elements conformally mounted as micro-strip on the substrate. Each of the radiating elements is of a triangular shape, and four of the radiating elements are arranged to form a crossed bowtie cloverleaf radiator. In addition, the four radiating elements form two pairs of radiating elements, and the two pairs of radiating elements are orthogonal to each other. The radiating elements are disposed on a front surface of the substrate, and a RF center conductor is orthogonally oriented toward a rear surface of the substrate and connected to one of the radiating elements for feeding a RF signal to the one radiating element.

18 Claims, 8 Drawing Sheets

U.S. PATENT DOCUMENTS

| | | | | |
|---|---|---|---|---|
| 6,992,632 | B1 | 1/2006 | Mohuchy | |
| 7,071,889 | B2 * | 7/2006 | McKinzie et al. | 343/756 |

FOREIGN PATENT DOCUMENTS

| | | |
|---|---|---|
| JP | 2003-087045 | 3/2003 |
| WO | WO 01/69724 A1 | 9/2001 |

OTHER PUBLICATIONS

S. Lindenmeier et al., "A Multifunctional Antenna for Terrestrial and Satellite Radio Applications", IEEE, 2001, pp. 393-396.
S. Ortiz et al., "A 25 WATT and 50 WATT KA-Band Quasi-Optical Amplifier", IEEE, 2000. pp. 797-800.
International Search Report, Appln. No. PCT/US2007/003593 dated Sep. 2, 2007.

* cited by examiner

HIGH POWER, POLARIZATION-DIVERSE CLOVERLEAF PHASED ARRAY

FIELD OF THE INVENTION

The present invention relates, in general, to an antenna and, more specifically, to a phased array antenna including multiple radiating elements arranged in a cloverleaf pattern. The phased array operates over multi-octave bandwidths, subtends a wide field-of-view, and responds to any desired polarization in space. The phased array is amenable to conformal installation and may transmit at high peak and high average power.

BACKGROUND OF THE INVENTION

Significant advances in broadband solid-state power generation have placed a new emphasis on phased arrays to efficiently combine the power of individual devices into high-power transmissions by exploiting the magnification property of phased arrays, known as the "array factor". Commensurate with this trend, the demands for high transmitted effective radiated power (ERP) have increased by as much as an order of magnitude. In addition, operating frequency range has been lowered into the HF/VHF region.

Along with the high effective radiated power, the multi-functional performance characteristics associated with phased arrays, such as multi-octave bandwidths, wide field-of-view, instantaneous multiple beams and polarization agility, must also be maintained.

Within the context of these requirements, emphasis must now be given to issues related to power handling within the array aperture, as well as the entire corporate feed structure. Power handling encompasses not only the capacity to sustain peak and average (CW) power demands, but also to be able to operate in adverse temperatures on the phased array.

The present application is related to U.S. Pat. No. 6,992,632 issued to Mohuchy on Jan. 31, 2006, entitled "Low Profile Polarization-Diverse Herringbone Phased Array", and U.S. Pat. No. 6,853,351 entitled "Compact High-Power Reflective-Cavity Backed Spiral Antenna", issued to Mohuchy on Feb. 8, 2005. The entire contents of both patents are incorporated herein by reference.

SUMMARY OF THE INVENTION

To meet this and other needs, and in view of its purposes, the present invention provides a phased array antenna including a substrate, and multiple radiating elements conformally mounted as micro-strips on the substrate. Each of the radiating elements is of a triangular shape, and four of the radiating elements are arranged to form a crossed bowtie cloverleaf radiator.

The four radiating elements form two pairs of radiating elements, and the two pairs of radiating elements are orthogonal to each other. Moreover, the radiating elements are disposed on a front surface of the substrate, and a RF center conductor is orthogonally oriented toward a rear surface of the substrate and connected to each of the radiating elements for feeding a RF signal to the radiating element.

The phased array antenna has the radiating elements disposed on a front surface of the substrate. A metallic ground layer is disposed facing a rear surface of the substrate, and a fluted core layer is sandwiched between the metallic ground layer and the substrate for channeled passage of coolant.

Each of the triangular shaped radiating elements includes a launch point disposed adjacent a vertex formed by two equal sides of an isosceles triangle. A pair of triangular shaped radiating elements are arranged to have the launch point of one of the radiating elements to be adjacent to the launch point of the other radiating element to form a first bowtie configuration. Another pair of triangular shaped radiating elements are arranged to have the launch point of one of the radiating elements of the other pair to be adjacent to the launch point of the other radiating element of the other pair to form a second bowtie configuration. The first bowtie configuration is arranged to be orthogonal to the second bowtie configuration.

A scan axis is included for the phased array antenna. A line may be formed extending from the vertex and intersecting a midpoint of a base of the isosceles triangle. This line forms a 45 degree angle with respect to the scan axis.

The phased array antenna includes a RF center conductor orthogonally oriented to one of the radiating elements for feeding a RF signal to the one radiating element. The RF center conductor includes a coaxial center conductor at one end, remote from the one radiating element, and a thinned center conductor at the other end, adjacent to the one radiating element. The RF center conductor also includes a wide center conductor extending between the thinned center conductor and the coaxial center conductor. The thinned center conductor has a diameter that is smaller than the wide center conductor. The thinned center conductor is connected to a launch point of the one radiating element with a screw inserted into a threaded receptacle of the thinned center conductor. Additionally, the wide center conductor includes an axial core for receiving the coaxial center conductor, and the coaxial center conductor is positively connected to the wide center conductor by way of a set screw inserted radially into the axial core for contacting the coaxial center conductor. The coaxial center conductor passes transversely through a metallic ground layer. The wide center conductor and the thinned center conductor are a single RF conductor, which passes transversely through a fluted core layer sandwiched between the metallic ground layer and the substrate.

Another embodiment of the present invention is a phased array antenna having a substrate, and multiple crossed bowtie cloverleaf radiators conformally mounted as micro-strips on the substrate. Each crossed bowtie cloverleaf radiator is shaped as identical first and second bowtie configurations, and the first and second bowtie configurations are oriented orthogonally to each other. Each of the first and second bowtie configurations includes two radiating elements. Each radiating element has a shape of an isosceles triangle, with a launch point disposed adjacent to a vertex opposite to a base of the isosceles triangle, and the respective launch points of the two radiating elements oriented proximate to each other, and the respective bases oriented remote from each other.

In addition, four RF center conductors are orthogonally oriented to one of the crossed bowtie cloverleaf radiators. Two of the four RF center conductors are connected to the first bowtie configuration, and the other two of the four RF center conductors are connected to the second bowtie configuration. A plurality of sets of four RF center conductors are orthogonally oriented to the multiple crossed bowtie cloverleaf radiators. Two of a set of four RF center conductors are connected to a respective first bowtie configuration, and the other two of the set of four RF center conductors are connected to a respective second bowtie configuration.

Still another embodiment of the present invention is a phased array antenna including multiple crossed bowtie cloverleaf radiators mounted on a first dielectric layer. Cooling channels are disposed within a second dielectric layer, and a metallic ground is formed on a third layer. The first, second and third layers are disposed in a sequence of first, second and third layers, and each of the crossed bowtie cloverleaf radiators includes a set of four radiating elements arranged in a cross-configuration. This phased array antenna includes multiple RF center conductors, where each of the RF center conductors is coupled to a respective one of the four radiating elements in the set.

It is understood that the foregoing general description and the following detailed description are exemplary, but are not restrictive, of the invention.

BRIEF DESCRIPTION OF THE DRAWING

The invention is best understood from the following detailed description when read in conjunction with the accompanying drawing. Included in the drawing are the following figures.

DETAILED DESCRIPTION OF THE INVENTION

Figure 1:
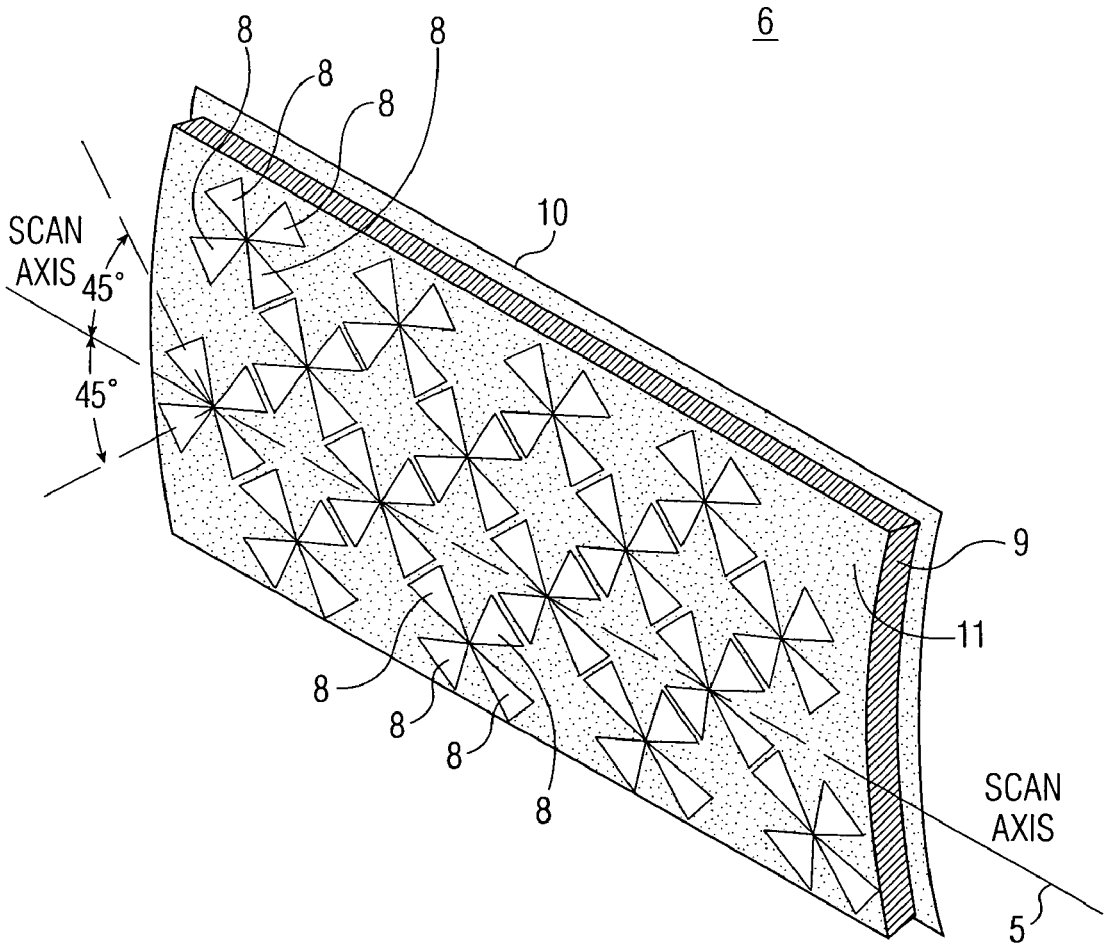
FIG. 1 is a partial perspective view of multiple radiating elements, each configured in a triangular pattern, where two orthogonal pairs of radiating elements form a crossed bowtie cloverleaf radiator that is conformally mounted as microstrips on a multilayer substrate to form a planar phased array antenna, according to an embodiment of the present invention.

Referring to FIG. 1, there is shown a partial perspective view of a phased array antenna, generally designated as 6, in accordance with an embodiment of the present invention. As shown, phased array antenna 6 includes multiple radiating elements 8, where each radiating element 8 is of a triangular shape. Four (4) radiating elements 8 are arranged as two (2) orthogonal pairs in a cloverleaf pattern, also referred to herein as a crossed bowtie cloverleaf radiator. The orthogonal pairs of elements 8 are formed conformally on thin substrate 11 and are disposed in a triangular grid according to the following relationship, which excludes the appearance of grating lobes:

$$\lambda/s=1+\sin\theta$$

where:

$\lambda$ is the wavelength at the highest operating frequency, s is the element spacing in the scanning direction, $\theta$ is the maximum array scan angle.

The orthogonal pairs of radiating elements 8 are positioned at 45 degrees relative to a scan axis of the phased array antenna, generally designated as 5. Although the scan axis is shown oriented along the X-axis, it will be appreciated that the scan axis may be oriented along the Y-axis, or any other angular orientation. The scan axis, for example, may also be of a conical scan orientation.

The substrate 11 is mounted on a fluted core layer of dielectric material, designated as core 9. The layer of core 9 is supported by a reflective, metallic ground plane, designated as 10. For discussion purposes, FIG. 1 shows only sixteen crossed bowtie cloverleaf radiators. The phased array antenna may include more or less than sixteen crossed bowtie cloverleaf radiators and may be arranged in a different triangular grid or aspect ratio.

Figure 2A:
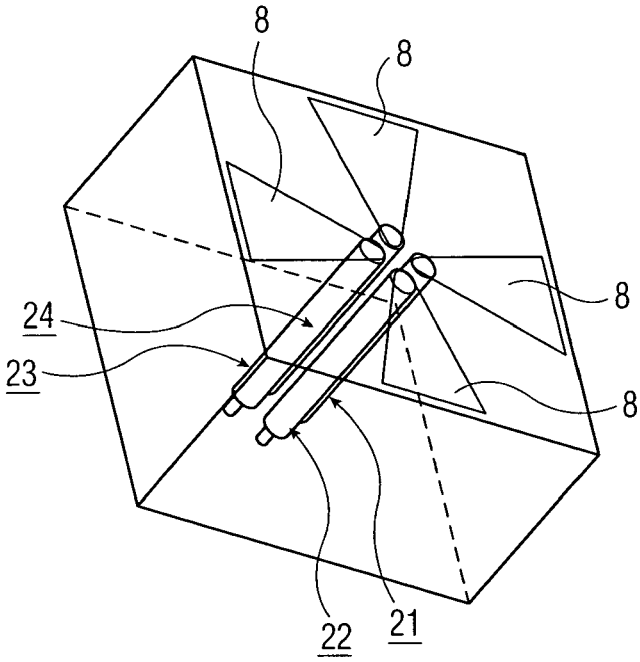
FIG. 2A is a perspective view of a single crossed bowtie cloverleaf radiator of the planar phased array shown in FIG. 1, including four RF center conductors each connected to a respective radiating element of the single crossed bowtie cloverleaf radiator, according to an embodiment of the present invention.
Figure 2B:
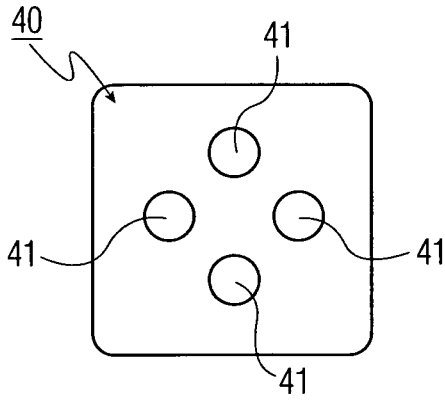
FIG. 2B is a top cross-sectional view of a dielectric spacer for receiving four RF center conductors for connection to four respective launch points of the single crossed bowtie cloverleaf radiator shown in FIGS. 2A and 2C, according to an embodiment of the present invention.
Figure 2C:
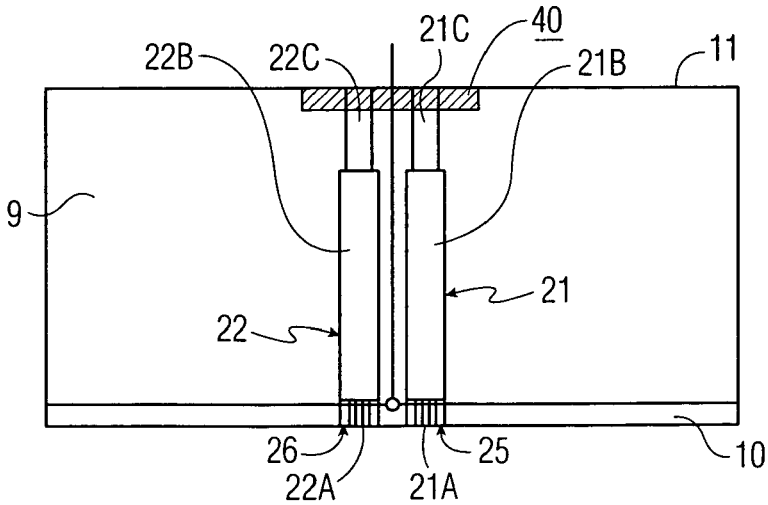
FIG. 2C is a front cross-sectional view of the single crossed bowtie cloverleaf radiator and its corresponding RF center conductors shown in FIG. 2A (only two RF center conductors are shown), according to an embodiment of the present invention.

The cloverleaf structure is shown in more detail in FIGS. 2A, 2B and 2C. The RF signal is inputted or received by means of a coaxial transmission medium, two of which are shown as coaxial portions 25 and 26 in FIG. 2A (only two coaxial portions 25 and 26 are visible in FIG. 2C; the other two orthogonal inputs are not included in the figure). Coaxial portions 25 and 26 include, respectively, coaxial conductors 21A and 22A, as shown.

Coaxial conductors 21A and 22A each forms one end of RF center conductors 21 and 22; wide center conductors 21B and 22B each forms a central portion of RF center conductors 21 and 22; and thinned center conductors 21C and 22C each forms the other end of RF center conductors 21 and 22. It will be understood that the coaxial conductor of the coaxial portion, the wide center conductor and the thinned center conductor form one continuous RF conduction path for coupling the RF signal from the input side to the output side of the radiating elements.

The RF signal is received via the four RF center conductors 21, 22, 23 and 24 (only RF center conductors 21 and 22 are visible in FIG. 2C; and four RF center conductors 21, 22, 23 and 24 are visible in FIG. 2A). The four RF center conductors terminate at four respective launch points of the crossed bowtie cloverleaf radiator, which includes four respective radiating elements 8. Accordingly, each of the four RF center conductors terminates at a corresponding launch point of one of the four radiating elements 8.

The four RF center conductors 21, 22, 23 and 24 extend sequentially through metallic ground plane 10, fluted core 9 and substrate 11, as shown in FIG. 2C (for clarity, only RF center conductors 21 and 22 are shown in FIG. 2C). The four RF center conductors 21, 22, 23 and 24 are supported at the feed end by four respective bulkhead coaxial connectors, one shown as 60 in FIG. 5. The same four RF center conductors are supported at the crossed bowtie cloverleaf end by a tailored dielectric spacer, shown as 40 in FIGS. 2B and 2C.

Figure 5:
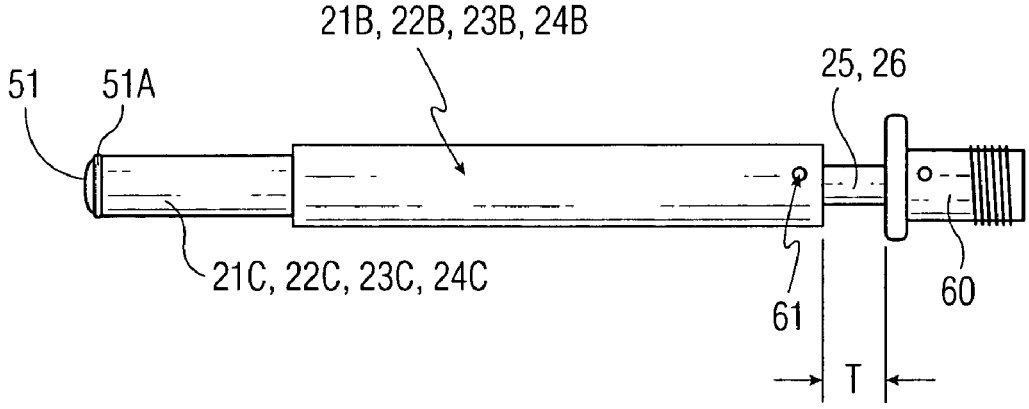
FIG. 5 is a detailed view of a single RF center conductor, employed in the RF feed to the crossed bowtie cloverleaf radiator of the planar phased array shown in FIG. 1, according to an embodiment of the present invention.

As best shown in FIGS. 2C and 5, each RF center conductor includes a coaxial conductor, originating at metallic layer 10 and extending through dielectric sleeve 25, 26. Each coaxial conductor is connected (described below), after leaving the dielectric sleeve, to wide conductor 21B, 22B, 23B and 24B. Each wide conductor extends into a thinned conductor, each designated as 21C, 22C, 23C and 24C. The thinned conductors, in turn, pass through holes 41 of dielectric spacer 40 (FIG. 2B).

Figure 3:
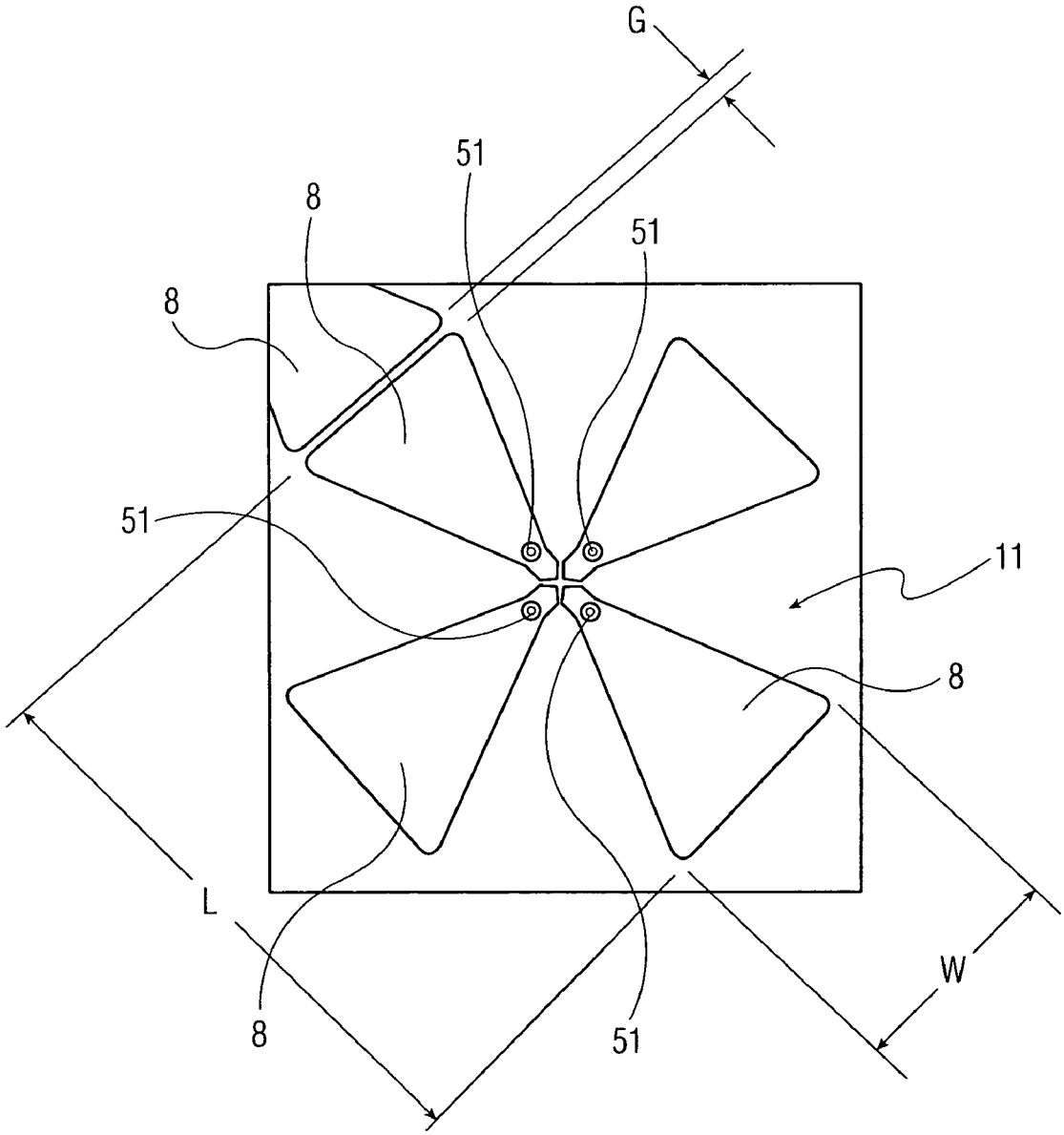
FIG. 3 is a close-up view of a single crossed bowtie cloverleaf radiator composed of four triangular radiating elements of the planar phased array shown in FIG. 1, according to an embodiment of the present invention.

The multiple radiating elements 8 are chemically etched on copper clad dielectric material, which forms substrate layer 11, in the manner depicted in FIG. 3. Connectivity to RF center conductors 21, 22, 23 and 24 is achieved with flat socket screws 51 to assure good contact between a respective RF center conductor and a launching point of a radiating element. One flat socket screw 51 is also shown in FIG. 5 with washer 51A interposed between socket screw 51 and thinned center conductor 21C, 22C, 23C and 24C.

Figure 4:
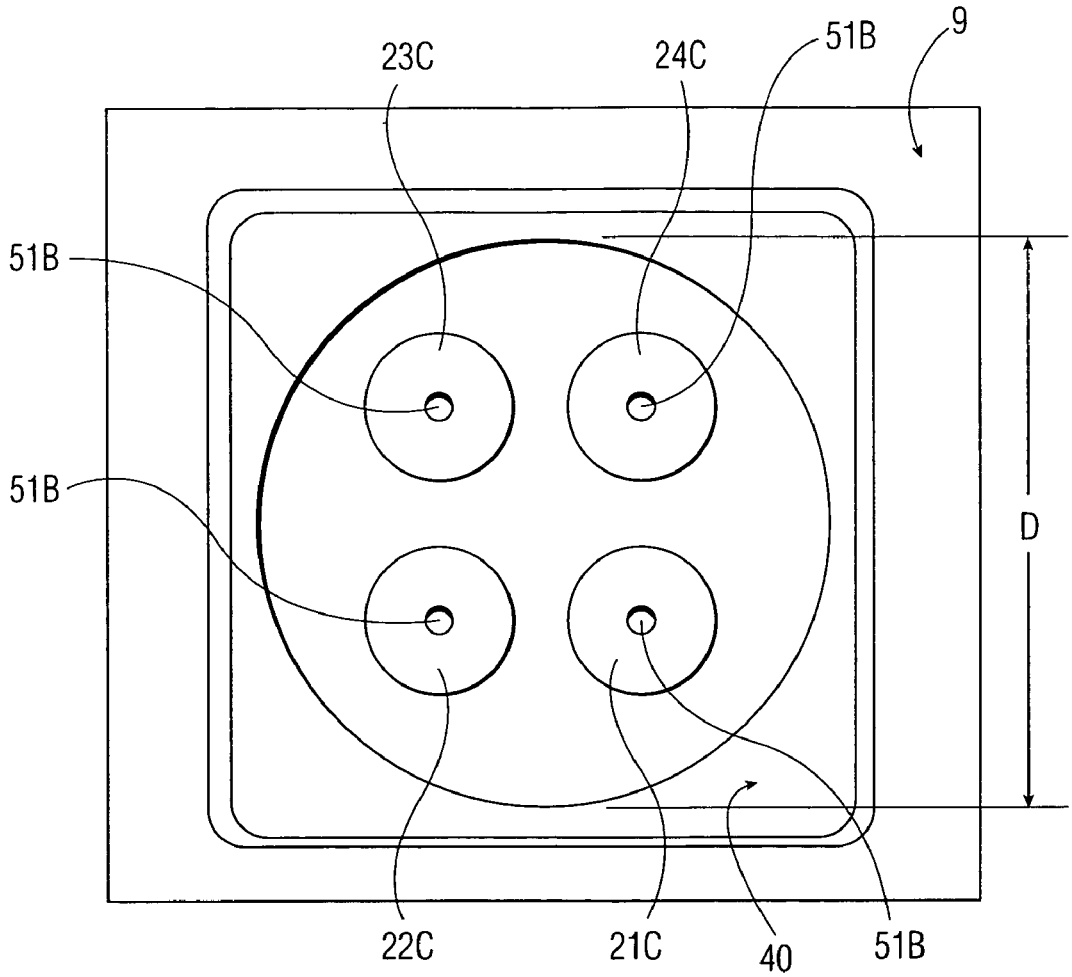
FIG. 4 is an interior cross-sectional view of the RF feed from four RF center conductors to the four launch points of the crossed bowtie cloverleaf radiator of the planar phased array shown in FIG. 1, according to an embodiment of the present invention.

FIG. 4 illustrates the relative position of the thinned center conductors, designated as 21C, 22C, 23C and 24C, within fluted core 9 and the attachment points of respective flat socket screws 51 into threaded cores 51B, the latter formed into each thinned center conductor. By passing flat socket screws 51 through substrate 11 at respective excitation ports of the bowtie radiators (FIG. 3) and threading them into threaded cores 51B, a solid connection is effectively made between the RF center conductor and its corresponding radiating element 8.

It will be appreciated that a portion of fluted core 9 is removed in the area of the four RF center conductors 21, 22, 23 and 24 to preclude contact with the core material and permit convective cooling. The core material is removed in area 40 of FIG. 4 which corresponds to the area of dielectric spacer 40 of FIG. 2B. In this manner, the tailored dielectric spacer 40 may nest in the removed portion of fluted core 9.

The RF center conductor, as shown in FIG. 5, includes a coaxial bulkhead connector 60 with its dielectric sleeve 25, 26 extending a distance T that corresponds to the thickness of metallic ground plane 10. The coaxial conductor of coaxial bulkhead connector 60 is positively joined to wide RF conductor 21B, 22B, 23B, 24B with set screw 61.

The four RF center conductors for a given crossed bowtie cloverleaf radiator are arranged as a balanced twin-lead transmission line pair. Each RF center conductor has a varying cross-sectional diameter along its length, so that it is thinner at its output end adjacent each radiating element 8. This thinning of the RF center conductor advantageously allows matching the excitation ports of the bowtie radiators with respect to a driving point impedance desired to achieve minimum signal reflection. The socket set screw 51 caps thinned center conductor 21C, 22C, 23C, 24C for a positive connection to a bowtie radiator input.

Figure 6:
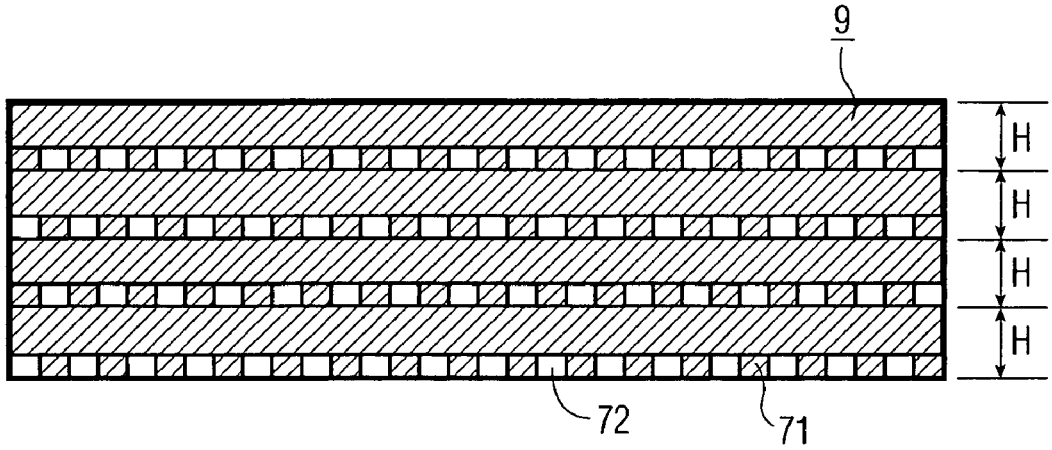
FIG. 6 is a cross-sectional view of the channeled, or fluted core layer, which is shown sandwiched in FIG. 1 between a metallic ground layer and a substrate layer that includes a chemically etched planar phased array, according to an embodiment of the present invention.

The fluted core 9 in FIG. 6 is a layered composite of dielectric material (one or more materials) that is channeled for coolant passage in either a vertical or horizontal orientation with respect to the scan axis of the phased array antenna, depending on the physical disposition of the coolant. The layers, denoted as having a thickness H, may be of one-inch thickness. One-half of the thickness H is a solid, shown designated as 71, and the other one-half of the core thickness H is fluted, shown designated as 72. The width of solid core 71 and the width of removed, or fluted core 72 are equal. The overall, total height of the fluted core (shown as 4H) is approximately equivalent to a quarter wavelength at the high frequency of the desired band.

A proof-of-concept phased array antenna, as embodied in the above described figures, was fabricated and measured in the 670-2000 MHz frequency band. The baseline for the phased array radiating aperture was determined using the general guidelines for biconical antennas, as outlined in Kraus, "Antennas", Second Edition, published by McGraw-Hill Book Co, 1988, chapter 8. Chapter 8 is incorporated herein by reference in its entirety. The initial dimensions were then optimized using a three-dimensional method-of-moments (MOM) tool that allowed construction of an array of crossed bowtie cloverleaf radiators. The resulting radiation patterns and driving port impedances, taking into consideration mutual impedance contributions, were computed.

The element dimensions were specifically optimized for a maximum operating bandwidth over a 120 degree field-of-view. The main tradeoff parameters, as shown in FIG. 3 were the length, L, of the bowtie (or a pair of radiating elements 8); the width, W, of the bowtie (or the pair of radiating elements 8); and their inter-element spacing, shown as gap, G, between one bowtie and another adjacent bowtie.

From a network point of view, the length L behaves as an inductive component, while the width W and the adjacent element gap G represent capacitance. The combined effect is a tank circuit which may be optimized for maximum operating bandwidth.

It will be appreciated that this optimization must include the entire field-of-view, because mutual coupling between adjacent elements varies significantly with the scan angle. A practical solution may be to focus on all scanned angles up to +/−45 degrees. Beyond the 45 degree scan coverage may be provided by pattern beam broadening effects.

A good indicator of array performance is the array VSWR (Voltage Standing Wave Ratio) for both the input to the array from the RF feed and the return loss seen by an incoming plane wave into the array. The desired figure of merit for both conditions is to operate a broadband array with a VSWR under 2:1. Practice, however, allows operating the array up to a 3:1 ratio, without significantly degrading the overall array operating efficiency.

Figure 7:
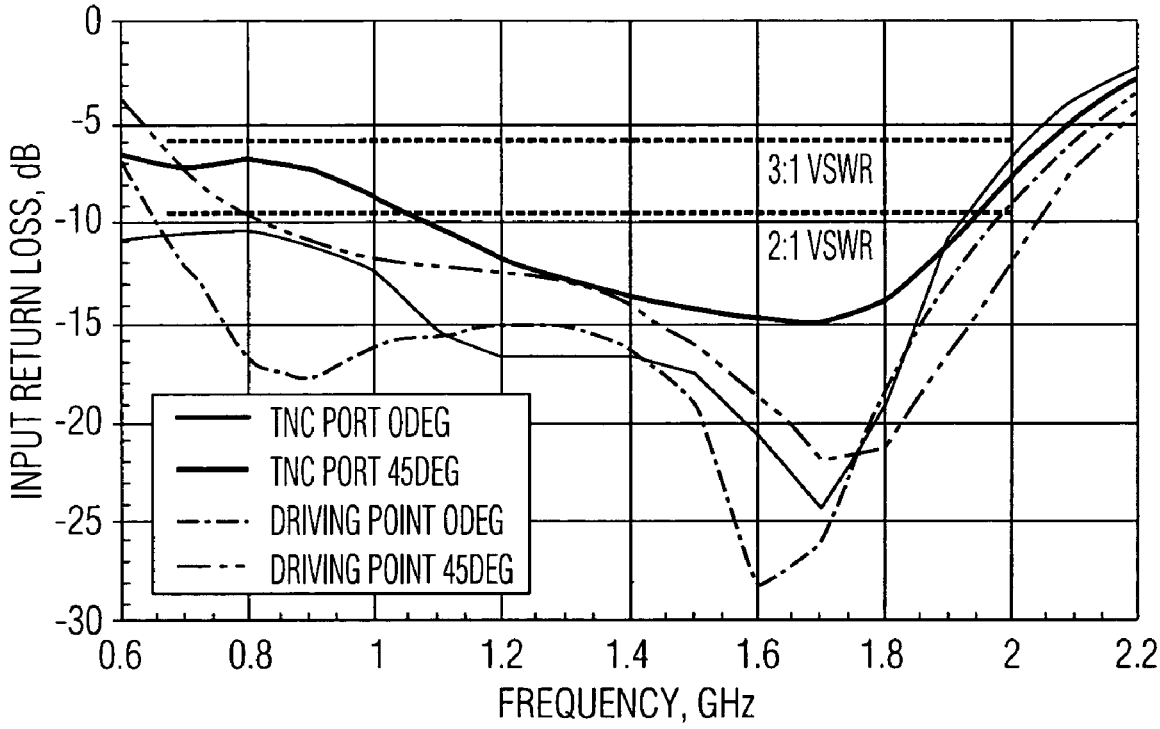
FIG. 7 is a plot of input return loss versus frequency of a prototype crossed bowtie cloverleaf planar phased array shown in FIG. 1, according to an embodiment of the present invention.
Figure 8A:
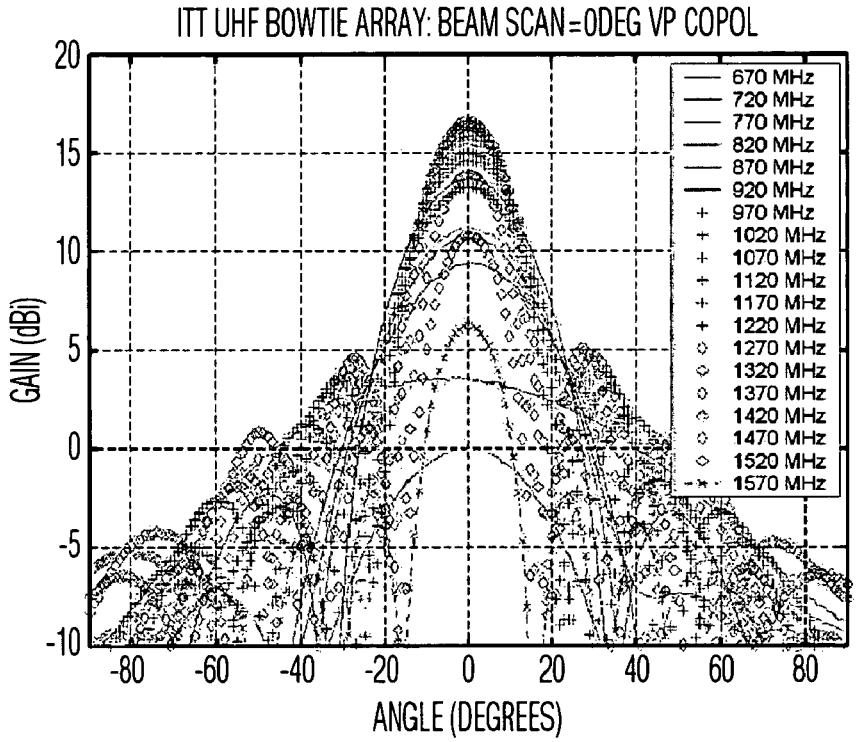
FIGS. 8A, 8B, 8C and 8D are sample radiating patterns of a prototype crossed bowtie cloverleaf planar phased array shown in FIG. 1, according to an embodiment of the present invention.
Figure 8B:
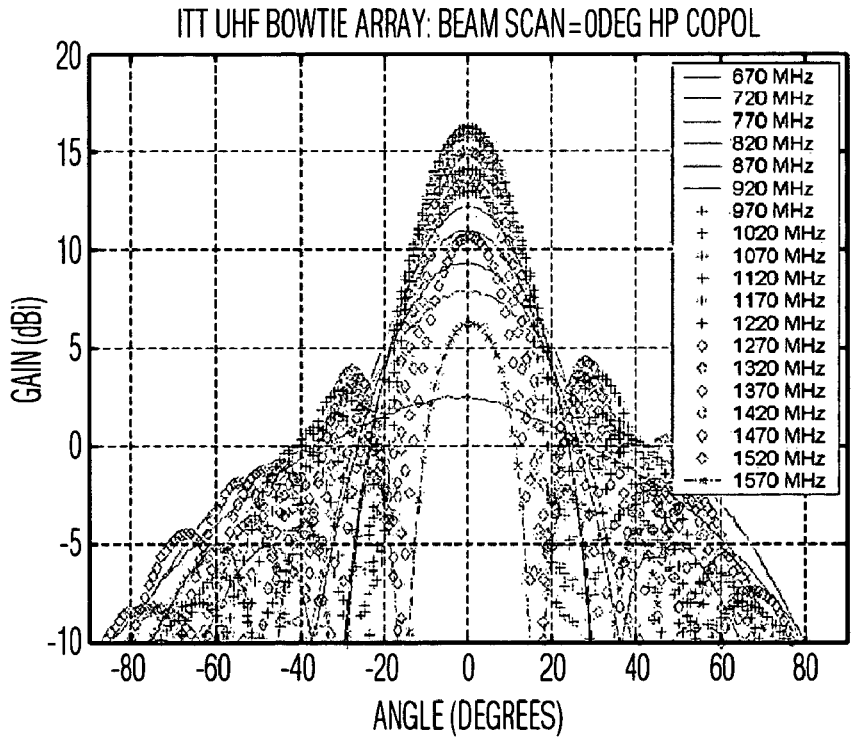
Figure 8C:
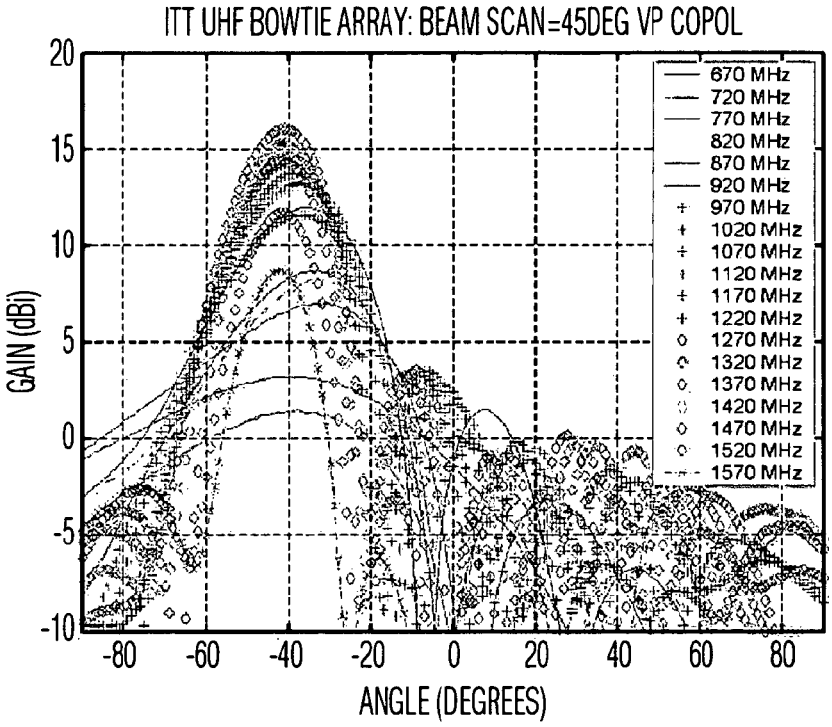
Figure 8D:
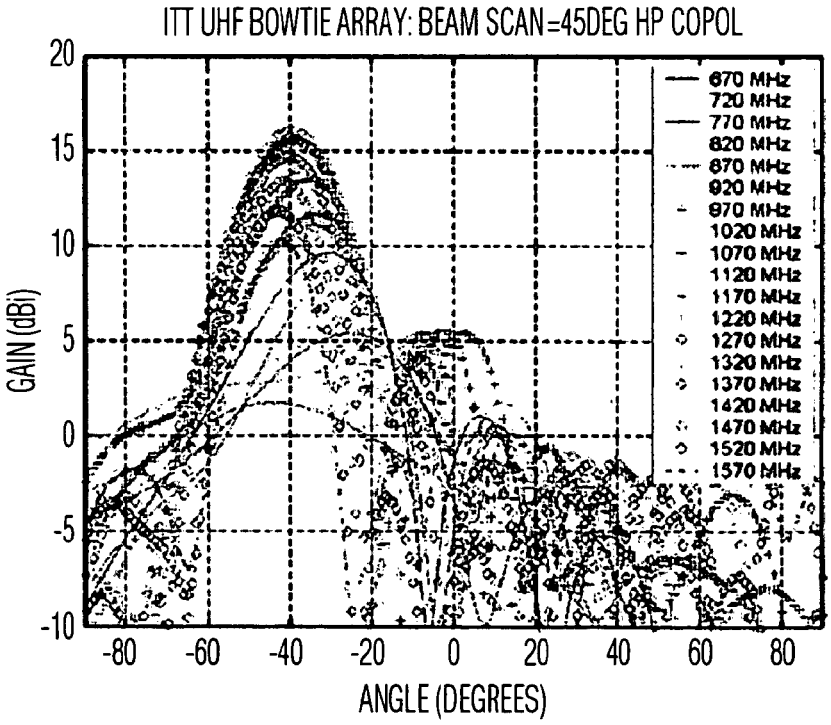

FIG. 7 shows the optimized VSWR performance of the proof-of-concept array. The TNC port designations refer to the array input, which was a coaxial TNC type connector having a characteristic impedance of 50 ohms. The driving point designations refer to the aperture mismatch to an incident plane wave and are referenced to the free space impedance of 377 ohms. The relationship between VSWR and Return Loss in FIG. 7 is as follows:

$$\rho=(\sigma-1)/(\sigma+1)$$

where: $\rho$ is Return Loss in voltage ratio $\sigma$ is VSWR in voltage ratio.

The aperture dimensions derived from the optimization are:

L=3.038 inches

W=0.981 inches

G=0.090 inches

The center to center element spacing in both the Azimuth and Elevation directions is 2.307 inches.

The center RF conductors, shown in FIG. 5, behave electrically as described in U.S. Pat. No. 6,853,351 with respect to FIG. 4 therein. The impedance, and hence the dimensions of the center RF conductors are determined by appreciating that they are pairs of transmission lines connecting the input of the array to each pair of radiating elements 8. The center RF conductors are also approximately $\lambda/4$ long, which is an ideal electrical length for a quarter-wave transformer.

The calculated impedance at the feed points of the bowtie (or pair of radiating elements 8) is 160 ohms. The RF coaxial connectors 60, when used as a pair, effectively represent 100 ohms. The resultant impedance then becomes 126 ohms, which corresponds to a wide center conductor (21B, for example) having a diameter of 0.34 inches. The center RF conductor (21, for example) is stepped down to 0.22 inch diameter forming the thinned center conductor (21C, for example) for approximately one fourth of the total length of center conductor 21. This dimension corresponds to the diameter of set screw 51 used to couple the bowtie input to the respective center RF conductor as a means of eliminating any possibility of RF corona between the set screw and the center RF conductor.

The fluted core shown in FIG. 6, in one exemplary embodiment, includes one dielectric material. For the proof-of-concept array structural foam was employed with a relative dielectric constant of 1.45. The material was available in one inch thick H panels, with the panels layered and thermally bonded into a single slab. Prior to bonding, each layer was machined to provide grooves over one half of the height H and spaced equally in width, with the groove position offset between adjacent layers, as shown in FIG. 6. The effective dielectric constant was computed on the basis of a volumetric average between the air and the remaining dielectric, resulting in a relative dielectric constant of 1.36.

Sample array patterns shown in FIG. 8 were measured with a True Time Delay (TTD) beam steering network, described in co-pending U.S. Pat. No. 6,992,632, which also provides the means for T/R capability and full polarization control. Advantages of the present invention is the implementation of a 180-degree phase bit to provide the required balanced field excitation at the bowtie terminals, and the elimination of the power-limited balun that has been the mainstay of the prior art.

The sample radiation patterns in FIG. 8 are the array response to vertically (V) and horizontally (H) polarized signals. The plots are referenced to the net array gain and are within the directivity predictions for the proof-of-concept aperture, indicating good efficiency both at boresite and when scanned to 40 degrees. The scanned beam maintains the 40-degree position over the measured frequency band, which is the expected performance from a TTD scanned array. At this scan angle, the beams broaden sufficiently to provide positive gain coverage out to 60 degrees, or a full 120-degree field-of-view.

Having described an embodiment of this invention, it is evident that other embodiments incorporating these concepts may be used. For example, frequency scaling of the dimensions may be used to operate in other frequency bands. The types of fasteners, connectors or dielectrics may be varied, with the appropriate electrical compensation. The array may be a planar or a conformally shaped structure deployed to any aspect ratio commensurate with the spatial coverage required.

Accordingly, although the invention has been described with a certain degree of particularity, it is understood that the present description is made only by way of example and that numerous changes in the details of construction, combination and arrangement of parts may be made without departing from the spirit and the scope of the invention.

What is claimed:

1. A phased array antenna comprising a substrate, and multiple radiating elements conformally mounted as micro-strips on the substrate, wherein each of the radiating elements is of a triangular shape, four of the radiating elements are arranged to form a crossed bowtie cloverleaf radiator, each of the triangular shaped radiating elements includes a vertex formed by two equal sides of an isosceles triangle extending from a base, and a line extending from the vertex and intersecting a mid-point of the base of the isosceles triangle forms a 45 degree angle with respect to a scan axis of the phased array antenna.

2. The phased array antenna of claim 1 wherein the four radiating elements form two pairs of radiating elements, and the two pairs of radiating elements are orthogonal to each other.

3. The phased array antenna of claim 1 wherein the radiating elements are disposed on a front surface of the substrate, and a RF center conductor is orthogonally oriented toward a rear surface of the substrate and connected to each of the radiating elements for feeding a RF signal to the radiating element.

4. The phased array antenna of claim 1 including the radiating elements disposed on a front surface of the substrate, a metallic ground layer disposed facing a rear surface of the substrate, and a fluted core layer sandwiched between the metallic ground layer and the substrate for channeled passage of coolant.

5. The phased array antenna of claim 1 wherein each of the triangular shaped radiating elements includes a launch point disposed adjacent a vertex, and a pair of triangular shaped radiating elements are arranged to have the launch point of one of the radiating elements to be adjacent to the launch point of the other radiating element to form a first bowtie configuration.

6. The phased array antenna of claim 5 including another pair of triangular shaped radiating elements arranged to have the launch point of one of the radiating elements of the other pair to be adjacent to the launch point of the other radiating element of the other pair to form a second bowtie configuration, and the first bowtie configuration is arranged to be orthogonal to the second bowtie configuration.

7. The phased array antenna of claim 1 including a RF center conductor orthogonally oriented to one of the radiating elements for feeding a RF signal to the one radiating element, and the RF center conductor including a coaxial center conductor at one end, remote from the one radiating element, and a thinned center conductor at the other end, adjacent to the one radiating element, and the RF center conductor including a wide center conductor extending between the thinned center conductor and the coaxial center conductor.

8. The phased array antenna of claim 7 wherein the thinned center conductor has a diameter that is smaller than the wide center conductor.

9. The phased array antenna of claim 7 wherein the thinned center conductor is connected to a launch point of the one radiating element with a screw inserted into a threaded receptacle of the thinned center conductor.

10. The phased array antenna of claim 7 wherein the wide center conductor includes an axial core for receiving the coaxial center conductor, and the coaxial center conductor is positively connected to the wide center conductor by way of a set screw inserted radially into the axial core for contacting the coaxial center conductor.

11. The phased array antenna of claim 7 wherein the coaxial center conductor passes transversely through a metallic ground layer, and the wide center conductor and the thinned center conductor are a single RF conductor, which passes transversely through a fluted core layer sandwiched between the metallic ground layer and the substrate.

12. A phased array antenna comprising a substrate, and multiple crossed bowtie cloverleaf radiators conformally mounted as micro-strips on the substrate, wherein each crossed bowtie cloverleaf radiator is shaped as identical first and second bowtie configurations, the first and second bowtie configurations are oriented orthogonally to each others, each radiating element has a shape of an isosceles triangle, with a launch point disposed adjacent to a vertex opposite to a base of the isosceles triangle, a scan axis for the chased array antenna, and a line extending from the vertex and intersecting a midpoint of a base of the isosceles triangle forms a 45 degree angle with respect to the scan axis.

13. The phased array antenna of claim 12 wherein each of the first and second bowtie configurations includes two radiating elements, the respective launch points of the two radiating elements are oriented proximate to each other, and the respective bases are oriented remote from each other.

14. The phased array antenna of claim 12 including four RF center conductors orthogonally oriented to one of the crossed bowtie cloverleaf radiators, wherein two of the four RF center conductors are connected to the first bowtie configuration, and the other two of the four RF center conductors are connected to the second bowtie configuration.

15. The phased array antenna of claim 12 including a plurality of sets of four RF center conductors orthogonally oriented to the multiple crossed bowtie cloverleaf radiators, wherein two of a set of four RF center conductors are connected to a respective first bowtie configuration, and the other two of the set of four RF center conductors are connected to a respective second bowtie configuration.

16. The phased array antenna of claim 12 including each crossed bowtie cloverleaf radiator disposed on a front surface of the substrate, a metallic ground layer disposed facing a rear surface of the substrate, and a fluted core layer sandwiched between the metallic ground layer and the substrate for channeled passage of coolant.

17. A phased array antenna comprising multiple crossed bowtie cloverleaf radiators mounted on a first dielectric layer, cooling channels disposed within a second dielectric layer, and a metallic ground formed as a third layer, wherein the first, second and third layers are disposed in a sequence of first, second and third layers, each of the crossed bowtie cloverleaf radiators includes at least two sets of four radiating elements arranged in a cross-configuration, and the at least two sets of four radiating elements are mounted on a single, continuous layer of the first dielectric layer.

18. The phased array antenna of claim 17 including multiple RF center conductors, wherein each of the RF center conductors is coupled to a respective one of the four radiating elements in the set.

* * * * *